US007640862B2

(12) United States Patent
Zamperla

(10) Patent No.: US 7,640,862 B2
(45) Date of Patent: Jan. 5, 2010

(54) ROLLER COASTER

(75) Inventor: Alberto Zamperla, Vicenza (IT)

(73) Assignee: Antonio Zamperla S.p.A., Vicenza (IT)

( * ) Notice: Subject to any disclaimer, the term of this patent is extended or adjusted under 35 U.S.C. 154(b) by 79 days.

(21) Appl. No.: 10/592,235

(22) PCT Filed: Dec. 14, 2004

(86) PCT No.: PCT/IB2004/004400

§ 371 (c)(1),
(2), (4) Date: Feb. 28, 2007

(87) PCT Pub. No.: WO2005/058445

PCT Pub. Date: Jun. 30, 2005

(65) Prior Publication Data

US 2007/0199474 A1 Aug. 30, 2007

Related U.S. Application Data

(60) Provisional application No. 60/529,913, filed on Dec. 15, 2003.

(51) Int. Cl.
*A63G 1/00* (2006.01)

(52) U.S. Cl. ..... 104/53; 472/1

(58) Field of Classification Search ..... 104/53, 104/63, 64, 65, 66, 57, 76; 472/1; 297/284.4, 297/391, 484
See application file for complete search history.

(56) References Cited

U.S. PATENT DOCUMENTS 5,272,984 A * 12/1993 Bolliger et al. ..... 104/63
5,979,333 A 11/1999 Houben et al.
6,158,354 A * 12/2000 Eiraku ..... 104/53
6,405,655 B1 * 6/2002 Clerx et al. ..... 104/63
6,513,441 B1 * 2/2003 Clerx et al. ..... 104/53
6,523,479 B1 * 2/2003 Schilke et al. ..... 104/57
6,606,953 B2 * 8/2003 Mares ..... 104/76
6,733,398 B1 * 5/2004 Clerx ..... 472/133
7,430,966 B2 * 10/2008 Mabillard et al. ..... 104/72
2001/0037745 A1 * 11/2001 Mares ..... 104/76
2002/0066387 A1 * 6/2002 Mares ..... 104/53
2003/0041769 A1 * 3/2003 Mares ..... 104/76

(Continued)

FOREIGN PATENT DOCUMENTS

WO WO 9702878 A1 * 1/1997

(Continued)

OTHER PUBLICATIONS

International Search Report, PCT International Application No. PCT/IB2004/004400, dated Apr. 13, 2005.

*Primary Examiner*—S. Joseph Morano
*Assistant Examiner*—Jason C Smith
(74) *Attorney, Agent, or Firm*—Kenyon & Kenyon LLP

(57) ABSTRACT

A roller coaster includes a cab that is rotatable between position for loading and unloading of passenger(s) and a position for riding the roller coaster. The cab includes a sliding pad mechanism, which is slidable on station entry and/or exit cams to move the cab between the two positions. In the position for loading and unloading the passenger(s), the cab is arranged so that the passenger(s) are non-parallel to a track of the roller coaster, and in the position for riding, the cab is arranged so that the passenger(s) are substantially parallel to the track.

18 Claims, 17 Drawing Sheets

U.S. PATENT DOCUMENTS

| | | | | |
|---|---|---|---|---|
| 2005/0274275 | A1* | 12/2005 | Gordon | 104/53 |
| 2006/0178221 | A1* | 8/2006 | Threlkel | 472/1 |
| 2007/0199474 | A1* | 8/2007 | Zamperla | 104/53 |
| 2008/0143158 | A1* | 6/2008 | Roodenburg et al. | 297/284.4 |

FOREIGN PATENT DOCUMENTS

| | | | |
|---|---|---|---|
| WO | 98/25678 | | 6/1998 |
| WO | WO 9825678 | A1 * | 6/1998 |
| WO | 99/22829 | | 5/1999 |
| WO | 99/22830 | | 5/1999 |
| WO | WO 9922830 | A1 * | 5/1999 |
| WO | 00/40315 | | 7/2000 |
| WO | 01/10524 | | 2/2001 |

* cited by examiner

ROLLER COASTER

CROSS-REFERENCE TO RELATED APPLICATIONS

This application claims the benefit of U.S. Provisional Patent Application Ser. No. 60/529,913, filed on Dec. 15, 2003, which is expressly incorporated herein in its entirety by reference thereto.

FIELD OF THE INVENTION

The present invention relates to a roller coaster. More particularly, the present invention relates to a roller coaster including a cab that rotates between a loading/unloading position, which may be a substantially vertical position relative to the ground, for loading and unloading of passenger(s), and a riding position, which may be a substantially horizontal position relative to the track along which the cab travels, for riding the roller coaster.

BACKGROUND INFORMATION

The growth of the amusement industry has led to the development of various exciting roller coaster designs. A roller coaster may allow the rider to securely soar in a prone "superego" position. A roller coaster of this type is believed to be described in U.S. Pat. No. 5,979,333.

Such prone riding roller coasters require a safe, controlled, reliable mechanism, involving minimum maintenance, to rotate the cab from the substantially vertical position to the substantially horizontal position at the ride station exit and to rotate the cab from the substantially horizontal position to the substantially vertical position at the ride station entry.

While other roller coasters may be suitable for the particular purpose employed, or for general use, they are not as suitable for the purposes of the present invention as disclosed hereafter.

SUMMARY

An exemplary embodiment of the present invention includes a roller coaster including a carriage and a cab that rotates relative to the carriage between a position for loading and unloading of a passenger and a position for riding the roller coaster. This loading and unloading position may be substantially vertical relative to the ground, e.g., substantially perpendicular to the track, and the riding position may be substantially horizontal to the ground, e.g., parallel to the track.

The cab includes two sliding pads, which slide on station entry and exit cams for rotating the cab between the loading and unloading position and the riding position, e.g., between the substantially vertical and horizontal positions. The cab further includes a first arm pivotally connected to the cab on one end and having a first cam follower, e.g., a wheel, on the opposite end and a second arm pivotally connected to the cab on one end and having a second cam follower, e.g., a wheel, on the opposite end.

The station exit cam has an upward sloping portion in the direction of travel of the vehicle. The sliding plates slide over the station exit cam to pivot, rotate and/or otherwise move the cab relative to the carriage from the loading and unloading position to the riding position. As the carriage moves in the direction of travel towards the station exit, the first cam follower is guided over a first exit cam connected to station exit cam, pivoting the arm relative to the cab and triggering a locking mechanism which locks the cab in the riding position, e.g., a substantially horizontal position, relative to the carriage. This locking mechanism assures that the rider is maintained in the riding position, e.g., a prone position relative to the track, throughout the ride. The locking mechanism may include one or more security bars connected on one end to the cab and engaging a locking retainer on the carriage on the other end. The locking mechanism may also include one or more security bars connected on one end to the carriage and engaging a locking retainer on the cab on the other end. Triggering of the locking mechanism extends the security bars into the locking retainer.

At the end of the ride, the carriage, still moving in the direction of travel, enters the station entry and passes over a station entry cam. The first cam follower is guided over a first entry cam which pivots its connected arm such that the cab is unlocked from the carriage. The first and second sliding pads slide along the station entry cam, having a downward slope in the direction of travel of the vehicle, causing the cab to pivot, rotate and/or otherwise move to a substantially vertical position as the carriage moves in the direction of travel. Further, the second cam follower is guided over a second entry cam causing the second arm to rotate and trigger an opening of a cage used to secure the rider within the cab during the ride.

During the course of the ride, between the station exit and the station entry, the rider may be maintained in a riding position that is substantially parallel to the track at the instantaneous position of the rider relative to the track. The track may include sloping portions relative to the ground and/or horizontal portions relative to the ground. During the course of the ride, or portion(s) thereof, motion and movement of the roller coaster along the track may be caused by gravity, a chain drive, motor drive, linear motor drive, magnetic levitation drive, a magnetic propulsion system, a pneumatic system, a hydraulic system, a pulley system, a cable drive system, etc.

In an example embodiment of the present invention, a roller coaster includes: a carriage; a cab at least pivotally connected to the carriage, the cab rotatable relative to the carriage between a first position substantially parallel to a track and a second position non-parallel to the track; and at least one of a station entry cam having a first predetermined profile and a station exit cam having a second predetermined profile. The cab may include a sliding pad mechanism configured to slide on at least one of the at least one of the station entry cam and the station exit cam to move the cab from a first one of the first position and the second position to a second one of the first position and the second position.

In an example embodiment of the present invention, a roller coaster includes: a track; a carriage movable along the track; a cab at least pivotally connected to the carriage, the cab at least rotatable relative to the carriage between a first position substantially parallel to the track and a second position non-parallel to the track; and at least one of a station entry cam having a first predetermined profile and a station exit cam having a second predetermined profile. The cab may include a sliding pad mechanism configured to slide on at least one of the at least one of the station entry cam and the station exit cam to move the cab from a first one of the first position and the second position to a second one of the first position and the second position.

In an example embodiment of the present invention, a roller coaster includes: track means; carriage means movable along the track means; cab means at least pivotally connected to the carriage means, the cab means including means for rotating the cab relative to the carriage means between a first position substantially parallel to the track means and a second position non-parallel to the track means; and at least one of station entry camming means and a station exit camming means. The cab means may include means for sliding on at least one of the at least one of the station entry camming means and the station exit camming means to move the cab means from a first one of the first position and the second position to a second one of the first position and the second position Example embodiments of the present invention may be embodied in the form illustrated in the accompanying drawings. Attention is called to the fact, however, that the drawings are illustrative only.

In the drawings, like elements are depicted by like reference numerals. The drawings are briefly described as follows.

DETAILED DESCRIPTION

Figure 1:
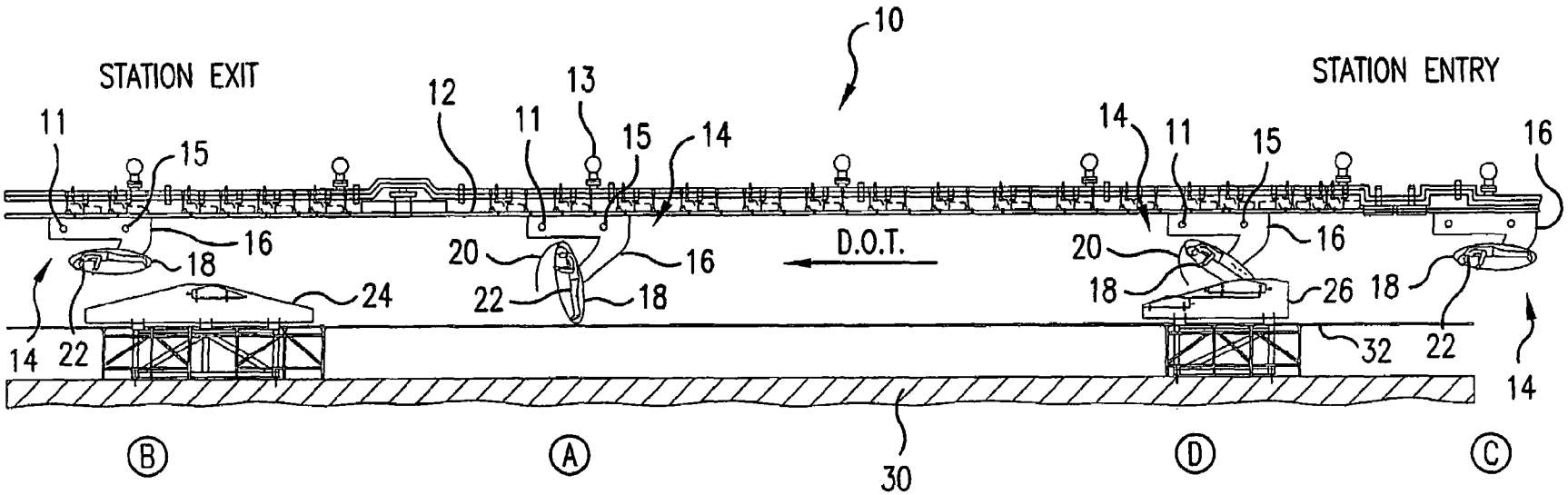
FIG. 1 is a side elevational view of the roller coaster station entry and exit.

FIG. 1 illustrates a side elevational view of an exemplary embodiment of a roller coaster station entry and exit of the present invention. An exemplary embodiment of a roller coaster 10 includes a vehicle 14 suspended from a track 12 and includes a carriage 16 and a cab 18. The carriage 16 is suspended from the track 12 at a front axle 11 and a rear axle 15. An arrow labeled D.O.T. indicates the direction of travel of the vehicle 14 as it passes through the stations. The carriage 16 may include a bumper to prevent steel-to-steel contact between the different vehicles in the station and on a storage track. While FIG. 1 illustrates a single vehicle 14, it should be understood that several vehicles 14 may be provided, e.g., side-by-side, in tandem, etc.

The cab 18 includes a cage 20 and a cover, e.g., a plexiglass cover, for securing a rider 22 in the cab 18 and preventing the rider's extremities from passing outside a clearance envelope around the vehicle 14. Cage 20 may be spring loaded, pneumatically actuated, hydraulically actuated, driven by a linear motor, rotary motor, geared transmission, chain/cable drive, cam driven, driven by a linkage system, etc.

The vehicle 14 is shown in various different ride states in FIG. 1. At ride state A, the cab 18 is in a loading/unloading position, e.g., substantially vertical relative to the ground and perpendicular to the track, allowing rider 22 to comfortably enter/exit the cab 18, e.g., by climbing up two or three steps on a ladder. The weight distribution of the cab 18, i.e., gravity, maintains the cab 18 in the loading/unloading position. Cage 20, which is biased in the open position by gas springs, is closed by an operator securing the rider 22 in the cab 18. As the cab 18 passes over the station exit cam 24, ride state B, it is gently forced into a locked riding position, e.g., substantially horizontal relative to the ground and parallel to the track, allowing the rider 22 to enjoy the roller coaster ride in a prone position with reference to the track, i.e., the rider 22 is substantially parallel to the track between the station exit and the station entry, or between portions thereof. After completion of the ride, the rider 22 enters the station entry, ride state C, still in the prone position. The cab 18 then passes over the station entry cam 26, ride state D, and is gently rotated back to the loading/unloading position. Platform 32 supports the rider 22 as he or she loads and unloads the cab 18. This system allows for a continuous flow during loading/unloading operations and supports to increase the capacity of the ride.

Figure 2:
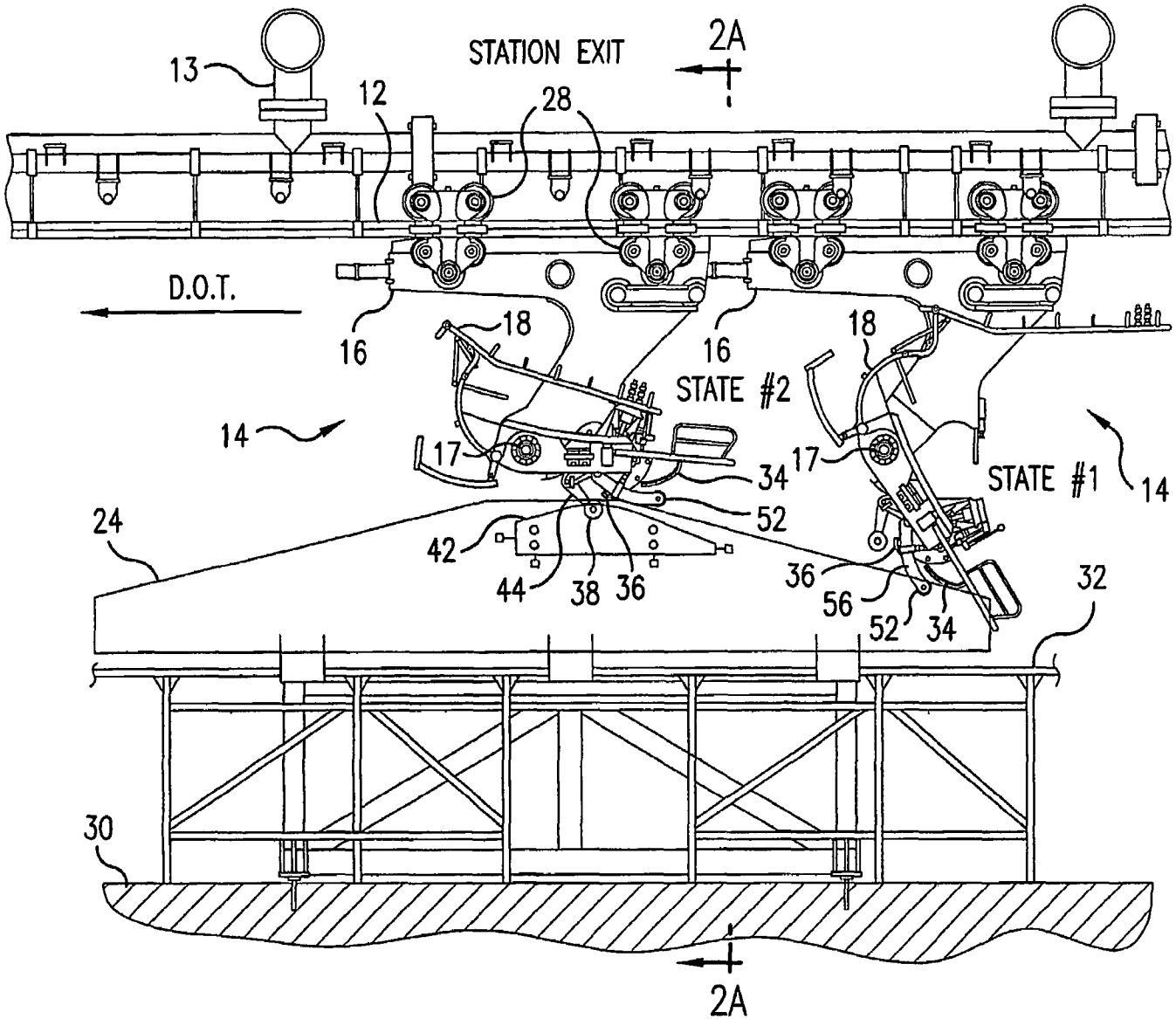
FIG. 2 is a side elevational view of the station exit.

FIG. 2 is a side elevational view of the station exit. The carriage 16 can be seen suspended to the track 12 via rollers 28 and is pushed by a series of kick-off motors 13. The cab 18 is pivotably connected to the carriage at a rotating axle 17. While still in the loading/unloading state, labeled State #1, and while moving in the direction of the arrow labeled D.O.T., a first sliding pad 34 connected to the cab 18 contacts station exit cam 24 and begins to slide on cam 24 on an upward slope causing the cab 18 to begin to rotate relative to the carriage 16. As the carriage moves further towards the station exit (in the figure, to the left), a second sliding pad 36 contacts station exit cam 24 and its sliding against station exit cam 24 further acts to rotate cab 18 relative to carriage 16 such that the cab 18 is in the riding position prior to leaving the station exit (State #2). A first cam follower 38, e.g., a wheel, connected to the cab 18 via arm 44 is guided, e.g., rolls, over a first exit cam 42 (shown in ghost lines because it is connected to the opposite non-visible of station exit cam 24) triggering the locking of cab 18 in the riding position relative to the carriage 16.

The locking mechanism may include one or more security bars connected on one end to the cab 18 and extendable into a locking retainer on the carriage 16. The locking mechanism may also include one or more security bars connected on one end to the carriage 16 and extendable into a locking retainer on the cab 18. The extension of the security bars may be triggered by the first cam follower 38 being guided over the first exit cam 42.

Locking/unlocking of the cab 18 and triggering of the locking/unlocking may be actuated by mechanisms other than the security bars, including proximity sensors, gas springs, solenoids, screw drives, linear motors, hydraulic systems, pneumatic systems, etc.

The first sliding pad 34 (also referred to as a skid plate) has a profile adapted to be in sliding contact with the station exit cam 24 over a first angular range between the loading/unloading position of the cab 18 and an intermediate angular position of the cab 18. In the intermediate position of the cab 18 both the first sliding pad 34 and the second sliding pad 36 (also referred to as a skid plate) are in sliding contact with the station exit cam 24. Upon further rotation of the cab 18 from the intermediate position toward the riding position, the first sliding pad 34 loses contact with the station exit cam 24, the cab 18 being thereafter rotated to the riding position by the sliding contact or camming action of the second sliding pad 36 and the station exit cam 24. As illustrated in the Figures, the second sliding pad 36 may be substantially flat and may be pivotable about an axis, e.g., by a pin connection, relative to the cab 18 to maintain sliding contact over substantially an entire surface of the second sliding pad 36. It should be appreciated that either one or both of the sliding pads 34, 36 may have any shape or may be stationary or pivotable in accordance with the desired pivoting motion of the cab 18 or in accordance with the profile of the station exit cam 24.

Figure 2A:
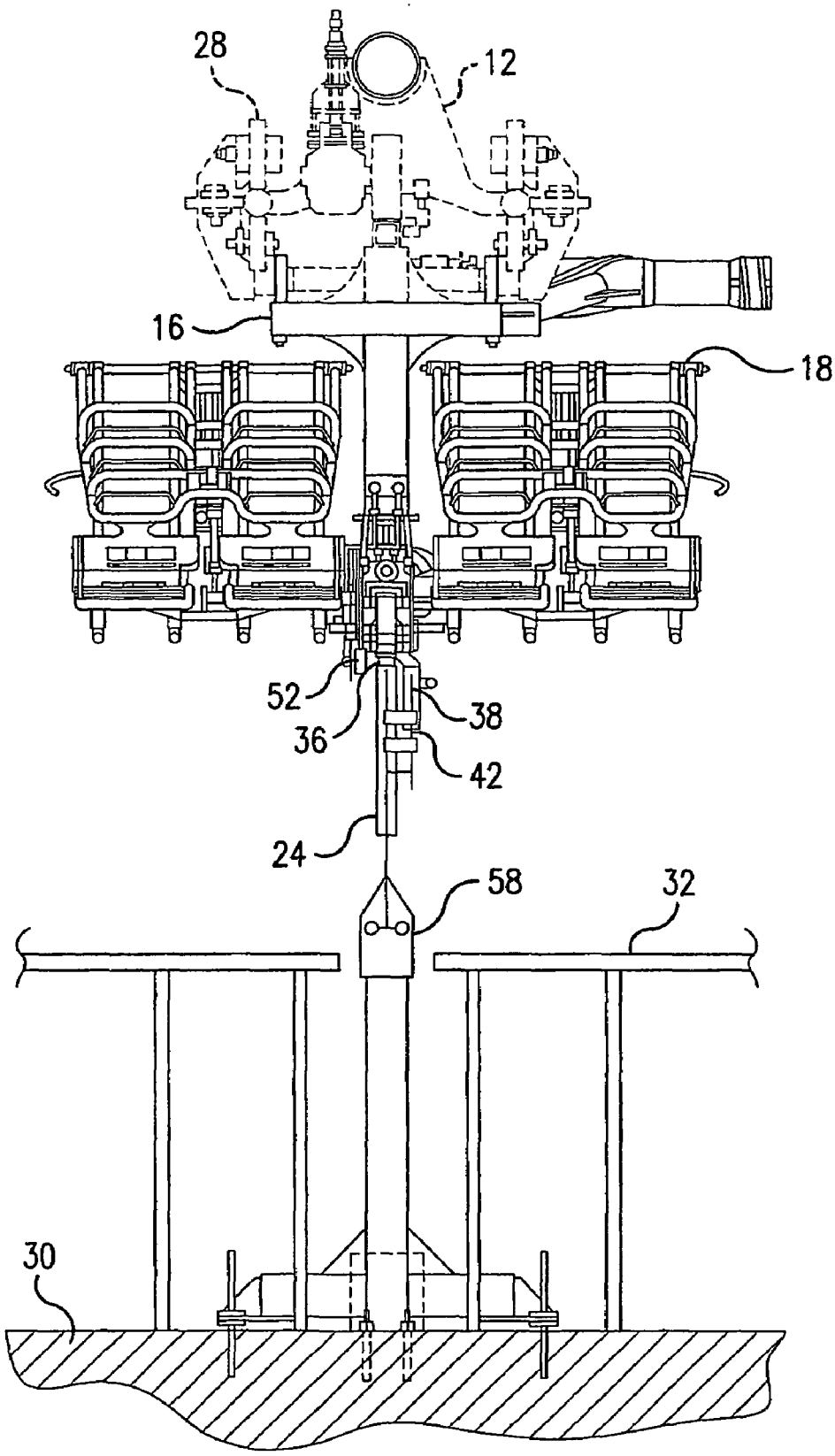
FIG. 2A is back view of the vehicle and station exit of FIG. 2 taken along the line 2A-2A.

FIG. 2A is a back view of the vehicle 14 taken along the direction of line 2A-2A in FIG. 2. First exit cam 42 is shown connected on one side of the station exit cam 24. The second sliding pad 36 can be seen sliding on station exit cam 24. Further, a support member 58 for station exit cam 24 is shown fixed to the ground 30.

Figure 3A:
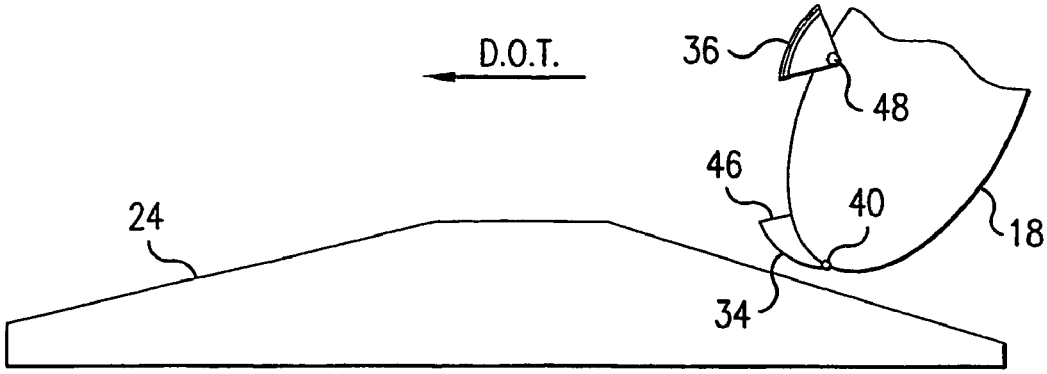
FIG. 3A is schematic view of a bottom portion of the cab just about to contact the station exit cam.
Figure 3B:
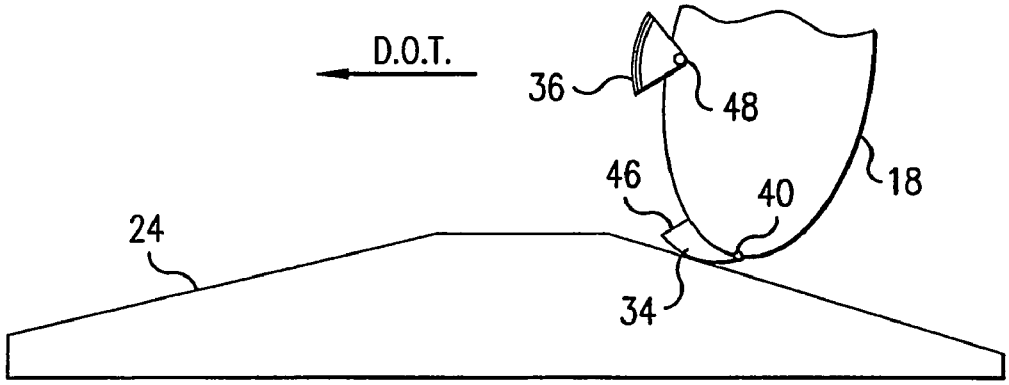
FIG. 3B is a schematic view of a bottom portion of the cab with the first sliding pad sliding on the station exit cam.
Figure 3C:
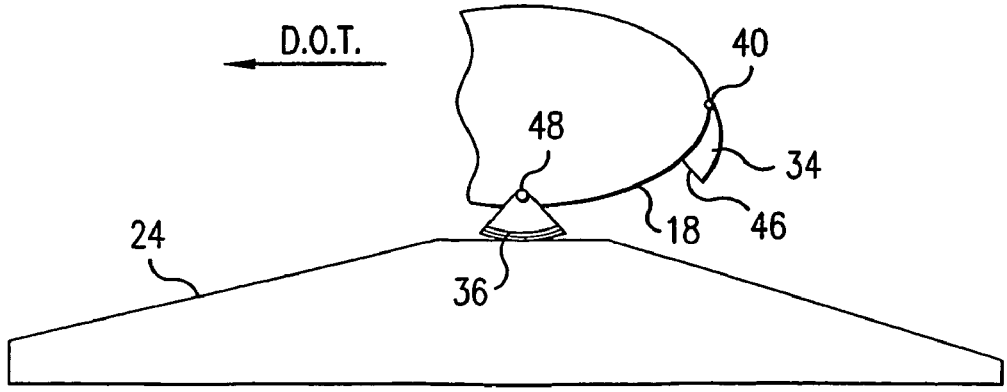
FIG. 3C a schematic view of a bottom portion of the cab with the second sliding pad sliding on the station exit cam.

FIGS. 3A to 3C illustrate how the first sliding pad 34 and the second sliding pad 36 operate to rotate the cab 18 into the riding position at the station exit. Only a simplified bottom portion of the cab 18 is shown for clarity. Sliding pad 34 is pivotally connected at pivot point 40 to the cab 18 and towards an opposite end may optionally be connected via a compression spring 46 to cab 18. Second sliding pad 36 is pivotally connected at pivot point 48 to cab 18.

FIG. 3A illustrates the cab 18 still in the loading/unloading position with sliding pad 34 about to contact station exit cam 24.

FIG. 3B illustrates the cab 18 a bit closer to the station exit with the sliding pad 34 in full contact with the station exit cam 24 and compression spring 46 in a fully compressed state. Sliding pad 34 slides along station exit cam 24 causing the cab 18 to pivot relative to the carriage 18.

FIG. 3C illustrates the cab 18 even closer to the station exit. The first sliding pad 34 has lost contact with the station exit cam 24 and the second sliding pad 36 contacts the station exit cam 24. As the carriage 16 moves further towards the station exit, the second sliding pad 36 continues to slide along the station exit cam 24 forcing the cab 18 into the riding position, illustrated at ride state B in FIG. 1.

Figure 4:
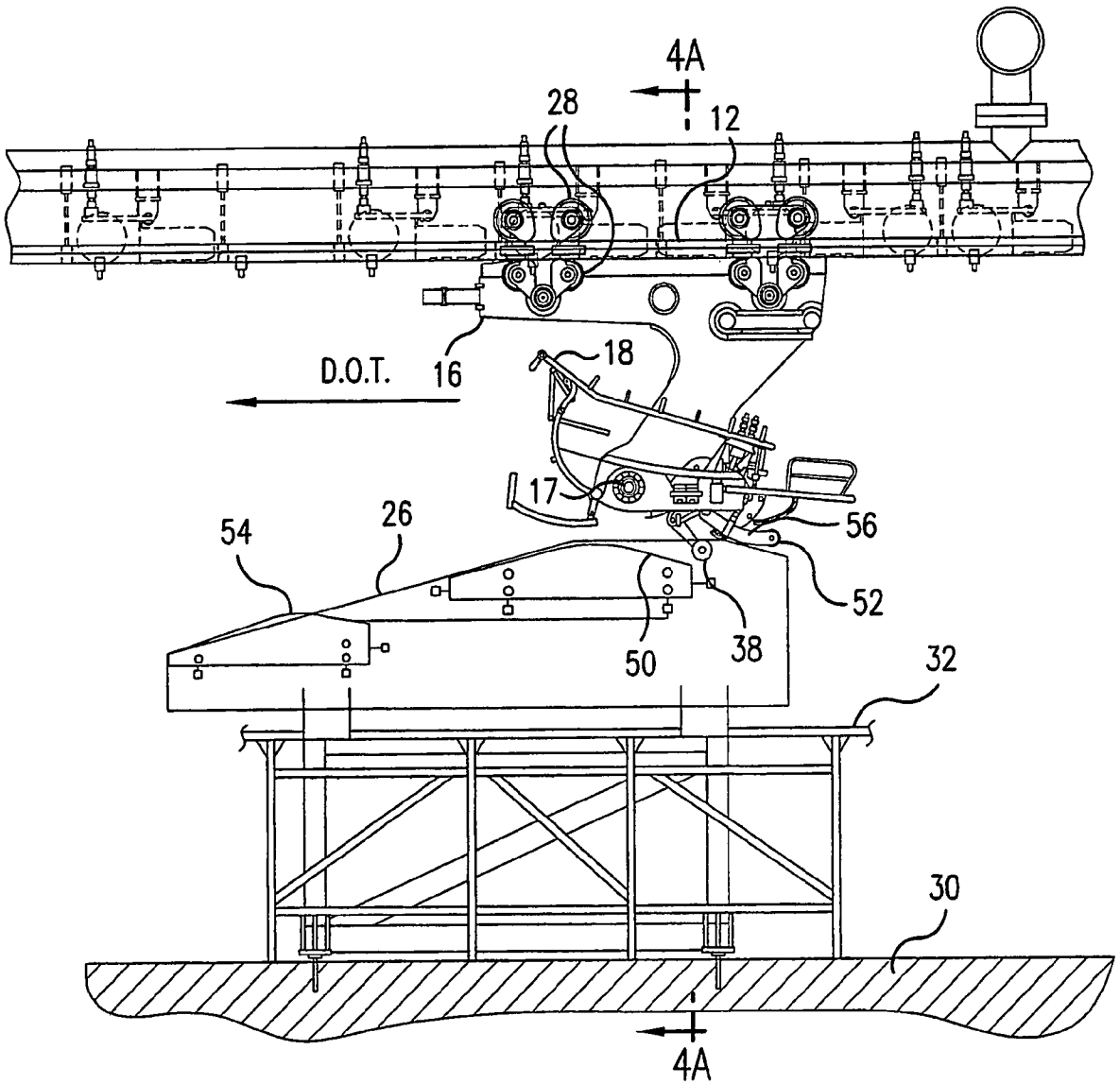
FIG. 4 is a side elevational view of the station entry.

FIG. 4 is a side elevational view of the station entry. As cab 18 passes over station entry cam 26 cam follower 38 is guided, e.g., rolls, over first entry cam 50 (shown in ghost lines because it is connected to the opposite non-visible side of station entry cam 26) which pivots arm 44 and unlocks the cab 18 from the carriage 16. As indicated above, the locking mechanism may include one or more security-bars, in which case, guiding of cam follower 38 over the first entry cam 50 retracts the security bar from the locking retainer on either the cab 18 or carriage 16. The station entry cam 26 via first sliding pad 34 pushes the vehicle 14 upward, e.g., about 4 to 5 mm. Second sliding pad 36 slides along station entry cam 26, having a downward slope, which causes the cab to rotate towards the loading/unloading position. See, for example, the rider states D and A in FIG. 1. As the cab 18 travels further in the direction of travel over station entry cam 26 second cam follower 52 is guided, e.g., rolls, over a second entry cam 54, which pivots a second wheel arm 56 which unlocks the cage 20, thus allowing, the rider 22 to exit the cab 18. A handle may also be provided on the outside of cab 18 to manually release or open the cage 20. The handle is not reachable by a rider 22 while in the cab 18.

Figure 4A:
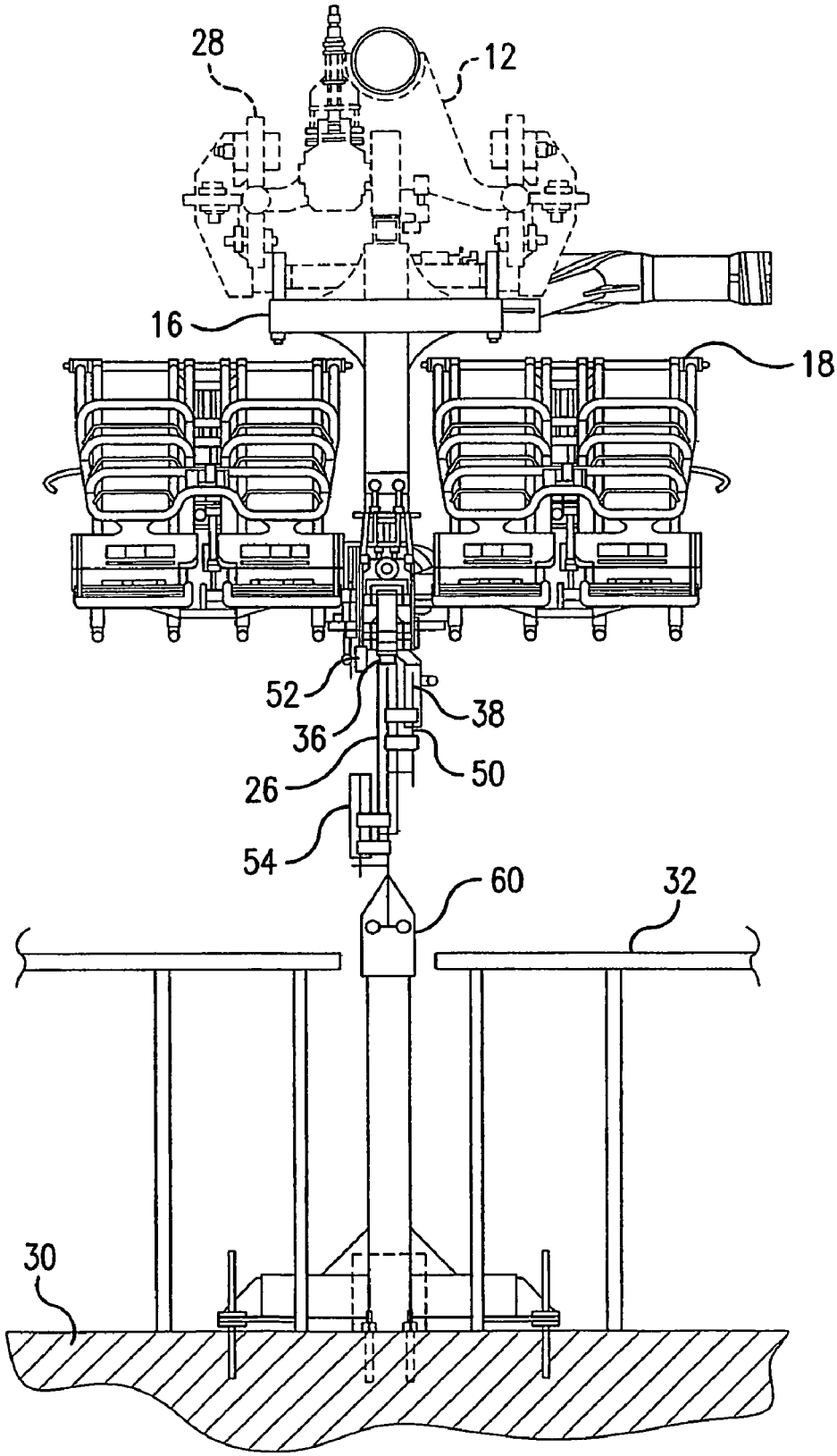
FIG. 4A is back view of the vehicle and station exit of FIG. 4 taken along the line 4A-4A.

FIG. 4A is a back view of the vehicle 14 taken along the direction of line 4A-4A in FIG. 4. First entry cam 50 and second entry cam 54 are shown connected on either side of the station entry cam 26. The second sliding pad 36 can be seen sliding on station entry cam 26. Further, a support member 60 for station entry cam 26 is shown fixed to the ground 30.

Figure 5A:
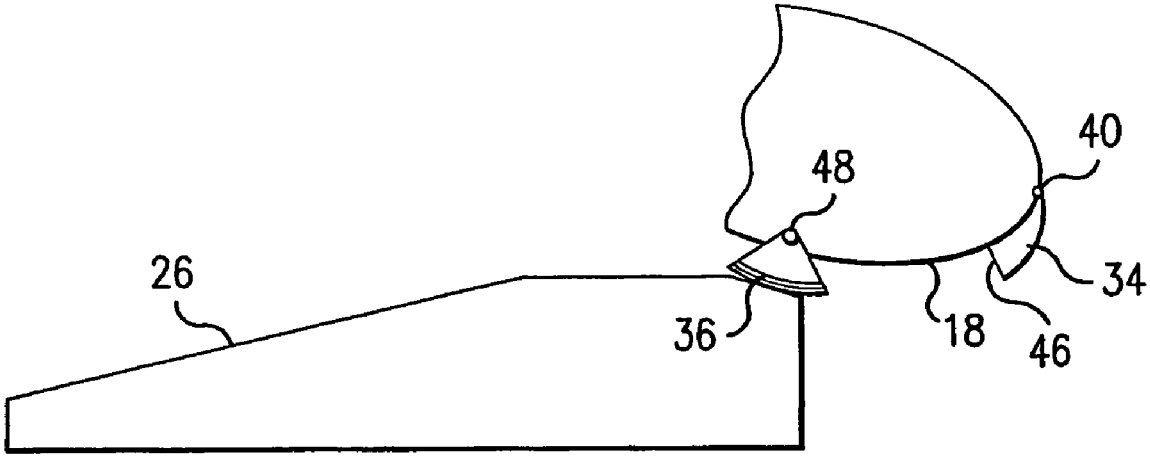
FIG. 5A is schematic view of a bottom portion of the cab with the second sliding pad sliding on the station entry cam.
Figure 5B:
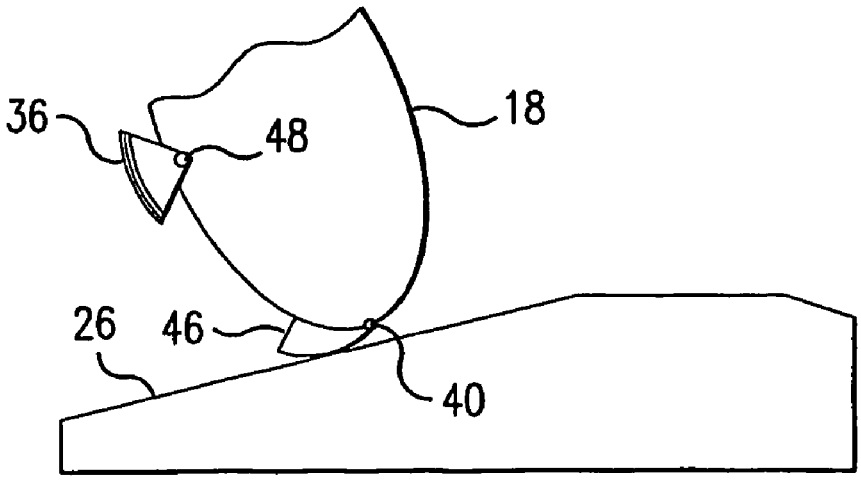
FIG. 5B is schematic view of a bottom portion of the cab with the first sliding pad sliding on the station entry cam.

FIGS. 5A and 5B illustrate how the first sliding pad 34 and the second sliding pad 36 operate to rotate the cab 18 into the loading/unloading position at the station entry 26. Only a simplified bottom portion of the cab 18 is shown for clarity. Security springs may be provided which resist rotation of the cab 18 from the riding position to the unloading/loading position.

FIG. 5A illustrates the cab 18 in the riding position with the second sliding pad 36 sliding against the station entry cam 26. As the carriage 16 is moved in the direction of travel the second sliding pad 36 loses contact with the station entry cam 26 and the first sliding pad 34, as can be seen in FIG. 5B, slides against the station entry cam 26 forcing the cab 18 to rotate relative to the carriage 16 to the loading/unloading position.

FIGS. 6 to 13 include photographs of an example embodiment of a roller coaster. Like numbers for like parts from FIGS. 1 to 5A are used for clarity.

Figure 6:
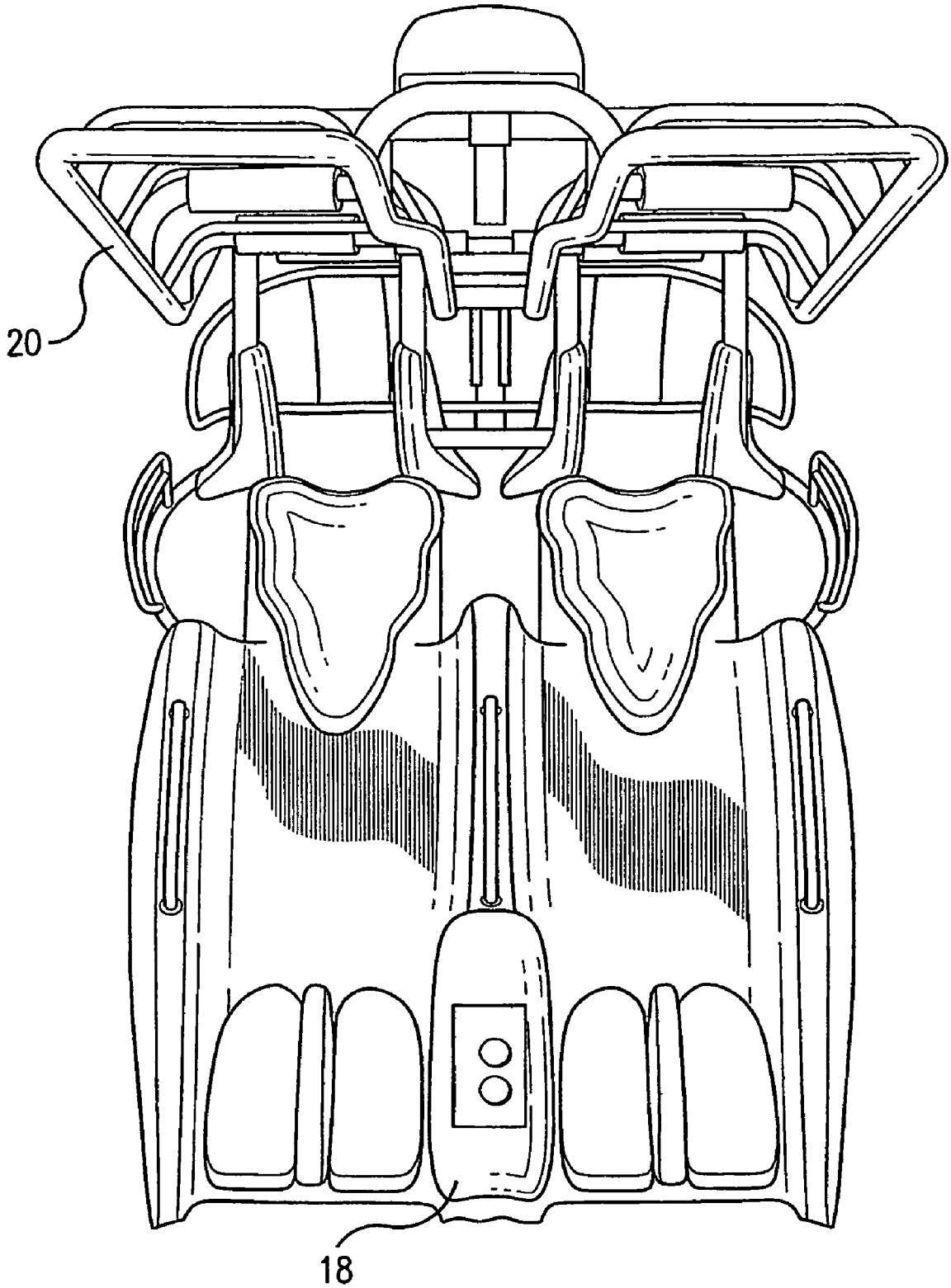
FIG. 6 is a photograph including a front view of the cab and the cage in an opened position.

FIG. 6 shows a yellow molded cab 18 and the tubular cage 20 in an opened position. The cab 18 may be configured to seat up to, e.g., four passengers in one row, two by two, right and left from the middle column. The cab 18 may be made from fiberglass and have foam parts for rider comfort. The cab 18 may also include hand grips and a ladder, made from aluminum, for example. The track 12 may be made from steel, for example.

Figure 7:
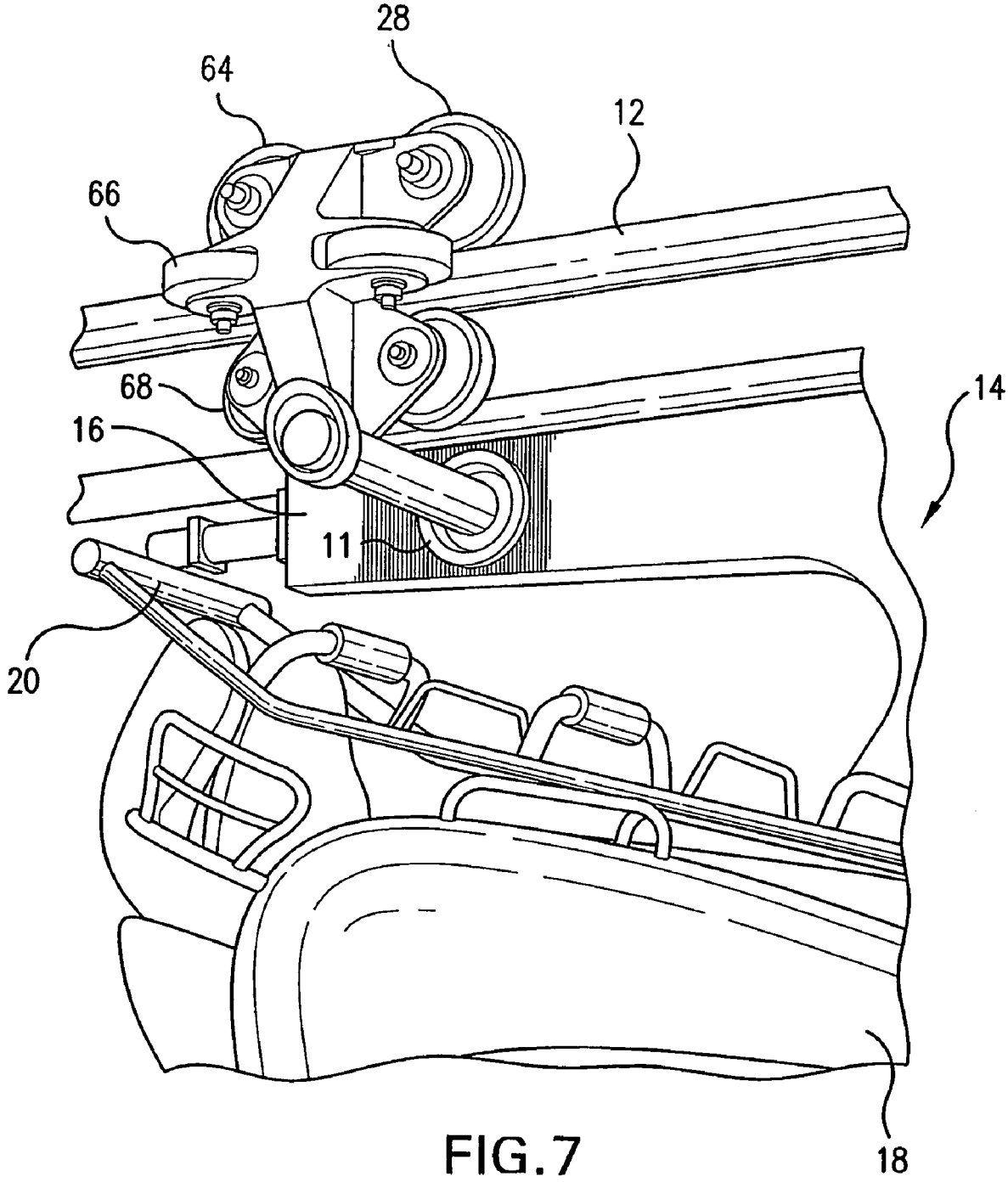
FIG. 7 is a photograph including a perspective view of the cab and carriage.

FIG. 7 shows the cab 18 in a horizontal position and the carriage 16 suspended from the track 12. Each cab 18 includes two main wheels 64, two guide wheels 66 and two up-stop wheels 68. Each of the wheels 64, 66 and 68 may be adjusted to track the track 12 as they begin to wear.

Figure 8:
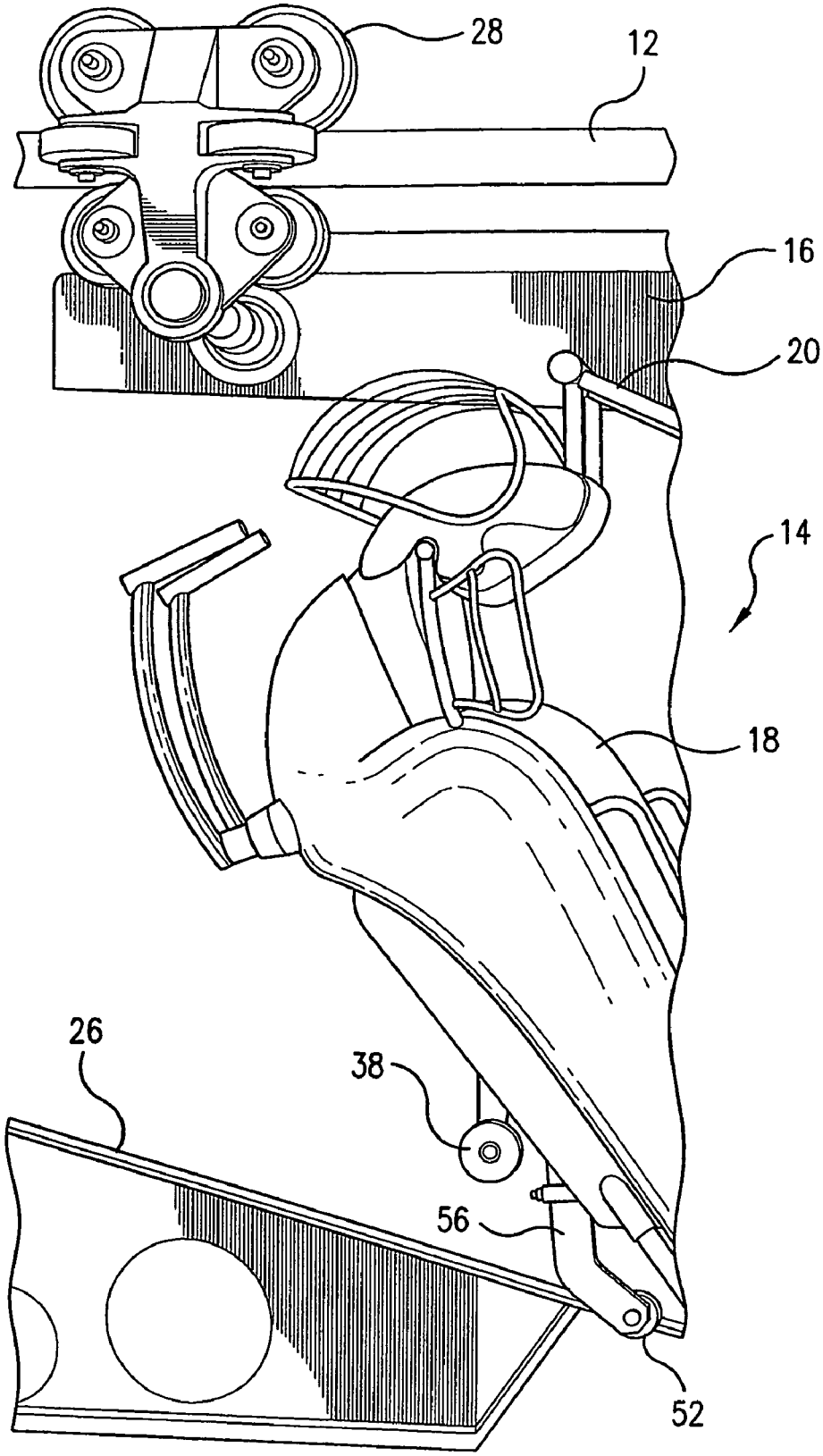
FIG. 8 is photograph including a side view of the vehicle just after it has passed over the station entry cam.

FIG. 8 is a side view of the vehicle 14 just after it has passed over the station entry cam 26.

Figure 9:
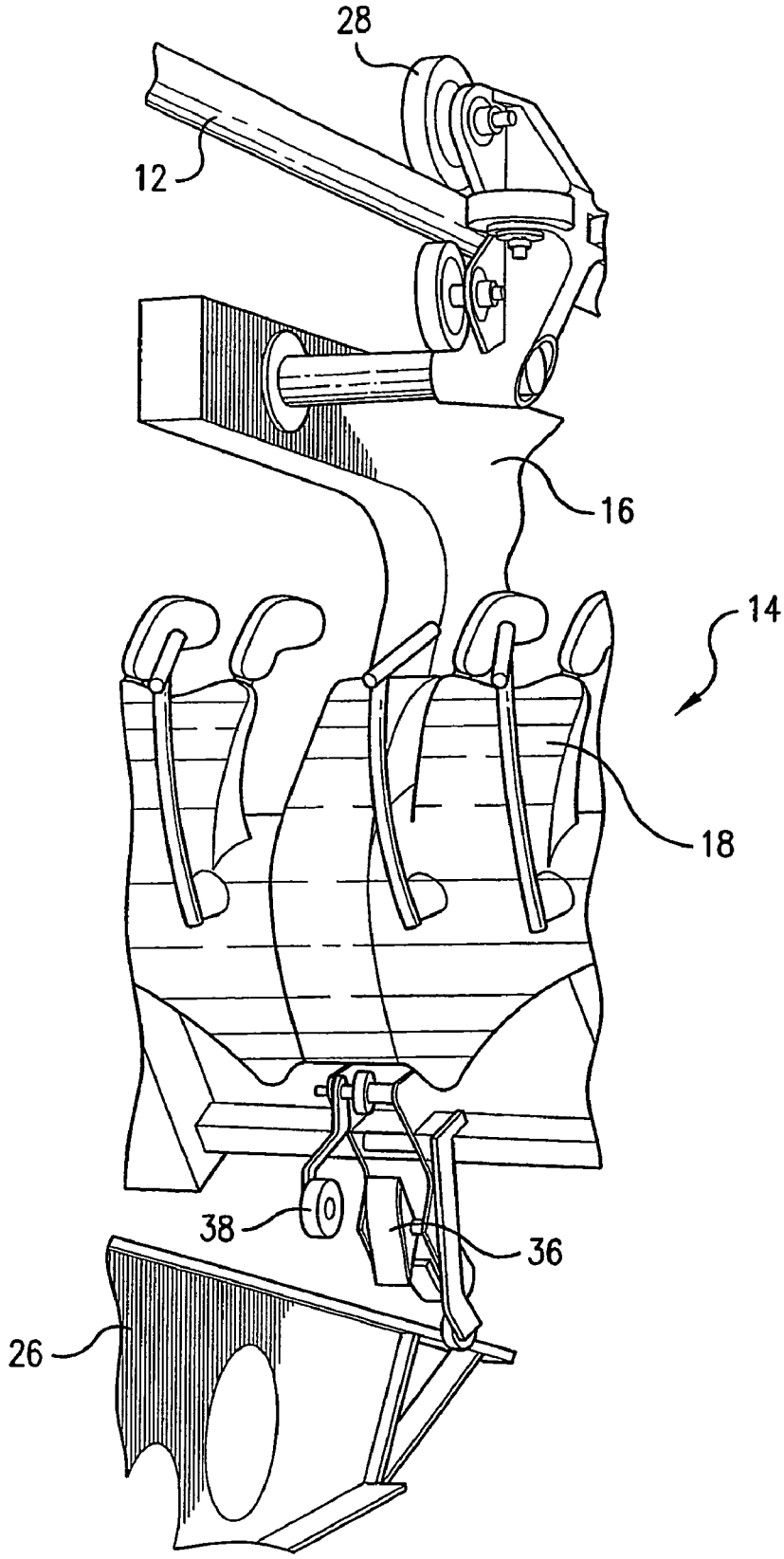
FIG. 9 is photograph including a back perspective view of the vehicle just after it has passed over the station entry cam.
Figure 10:
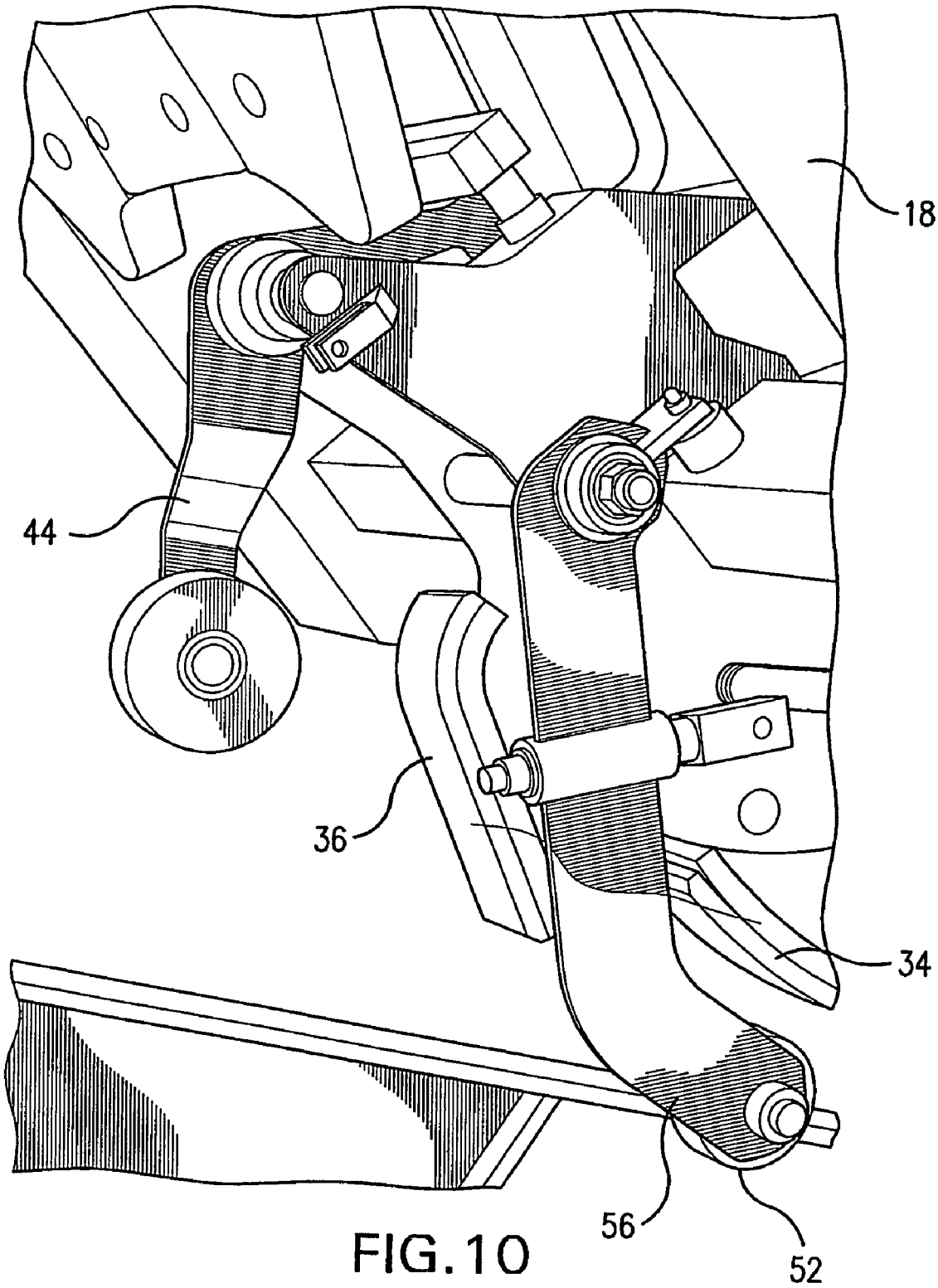
FIGS. 10 to 13 are photographs including various bottom perspective views of the cab.
Figure 11:
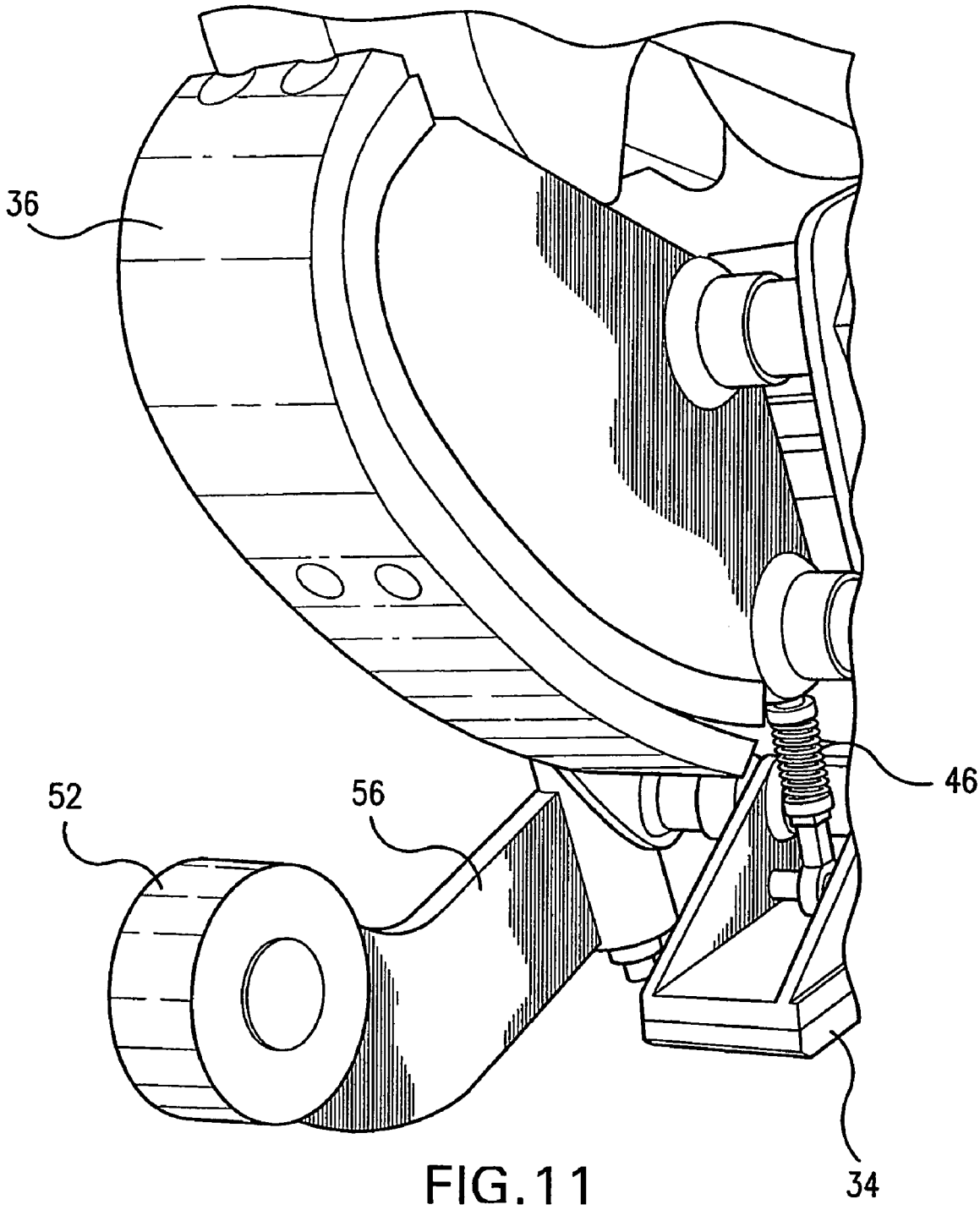
Figure 12:
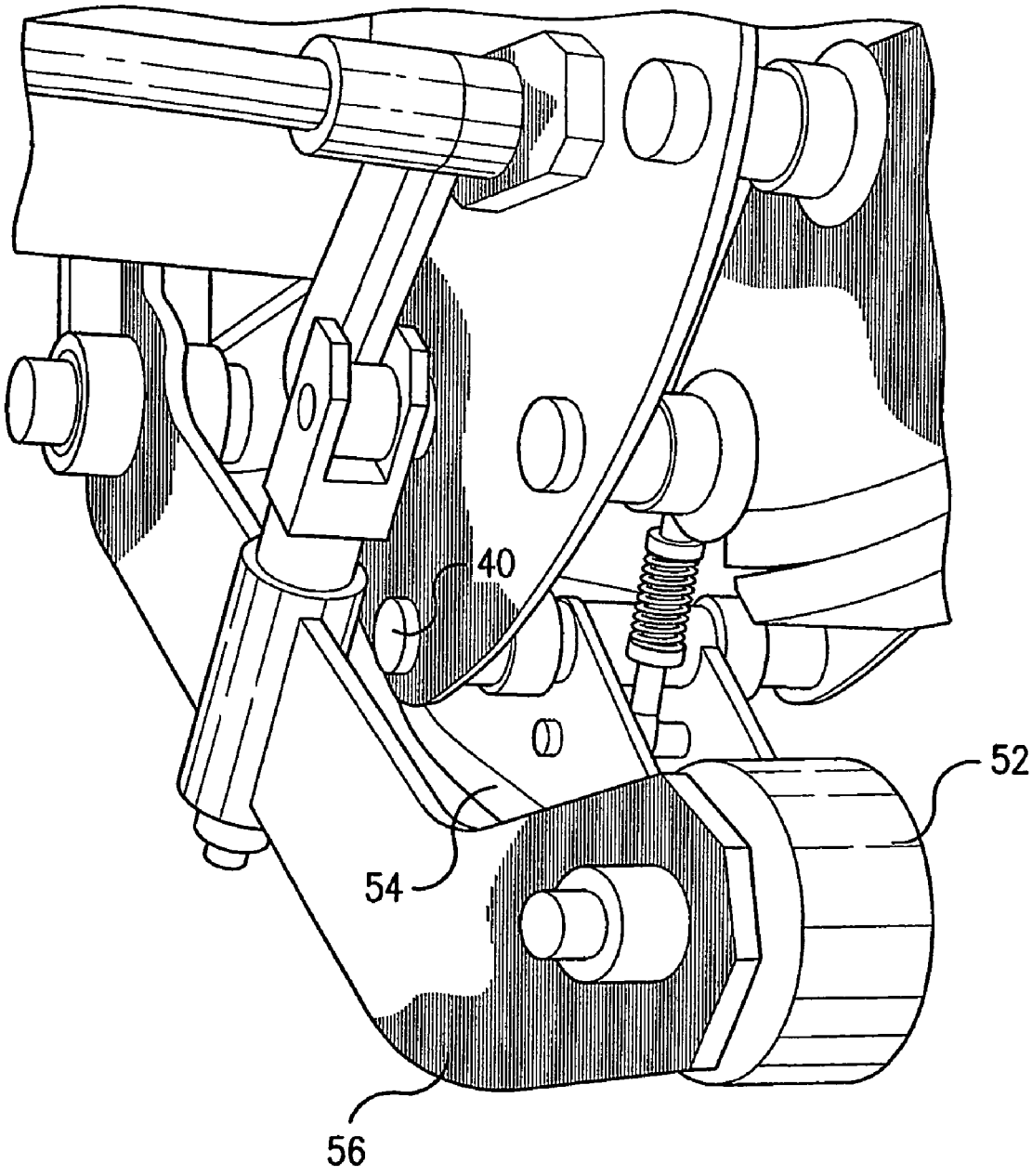
Figure 13:
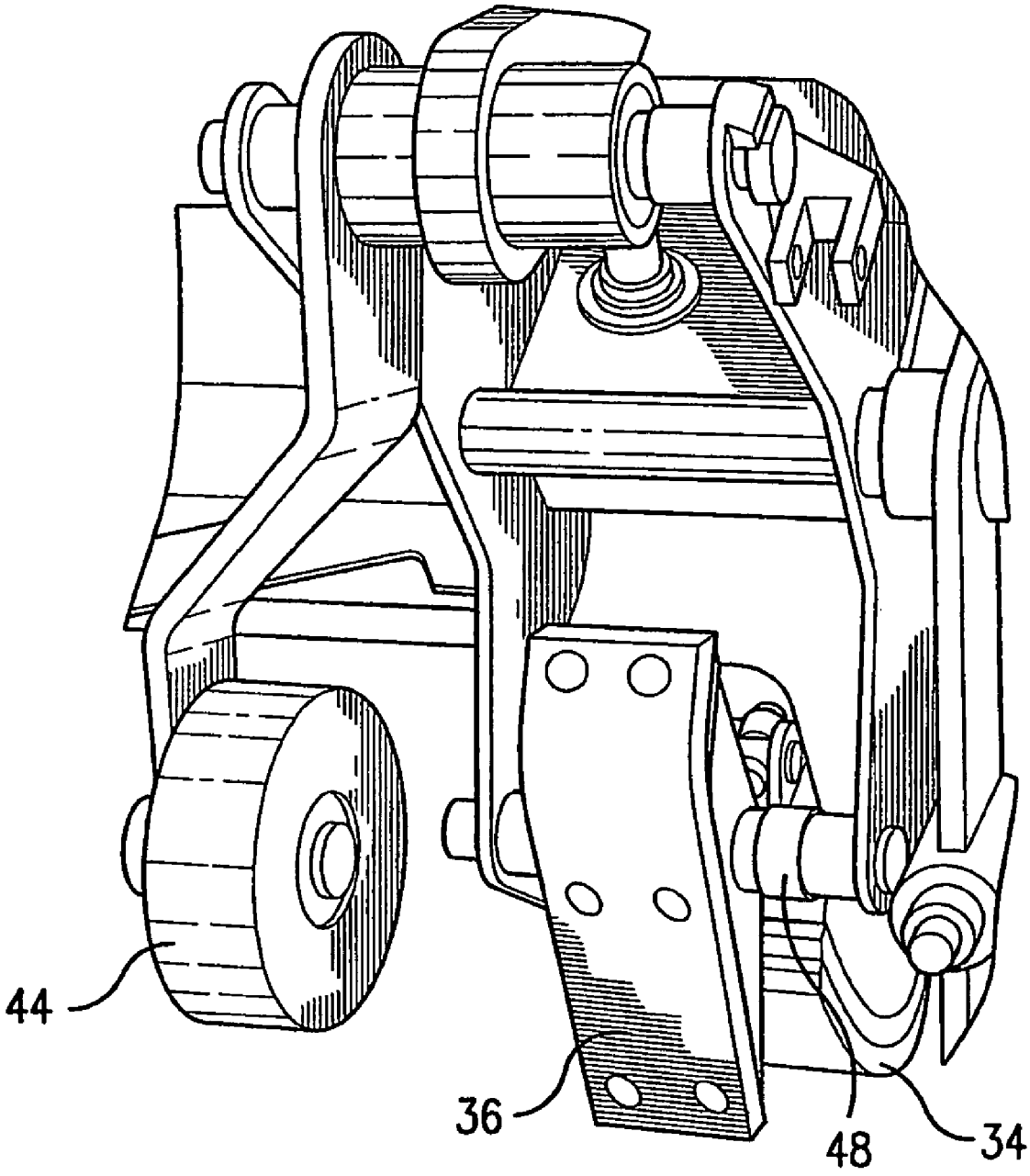

FIG. 9 is a back view of the vehicle 14 just after it has passed over the station entry cam 26.

FIGS. 10 to 13 are bottom perspective views of the cab 18.

Figure 14:
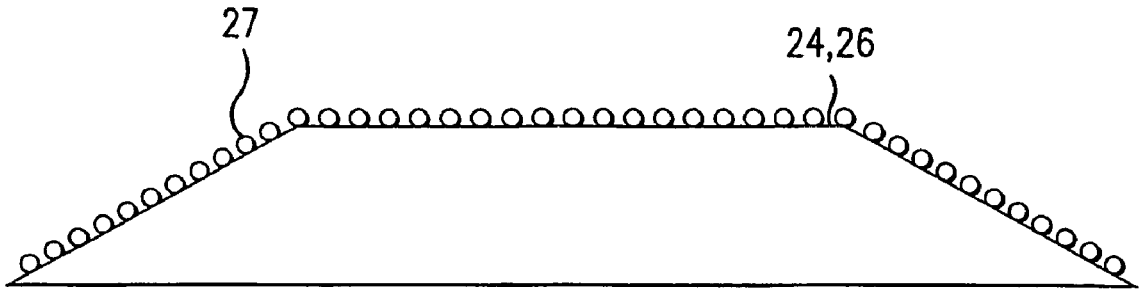
FIG. 14 is a side elevational view of an alternative station exit or entry cam including rollers.
Figure 15:
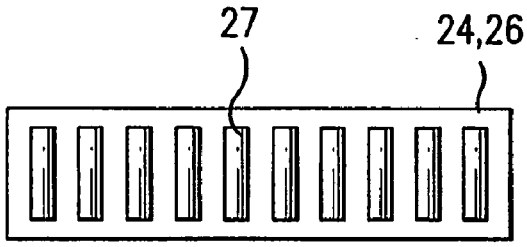
FIG. 15 is a top view of a portion of the station exit or entry cam of FIG. 14 including an exemplary arrangement of the rollers of FIG. 14.
Figure 16:
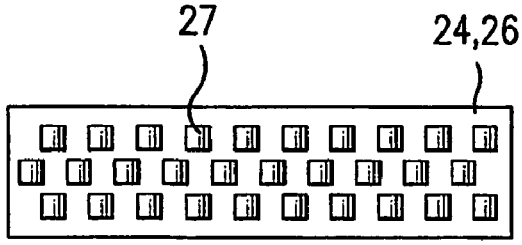
FIG. 16 is a top view of portion of the station exit or entry cam including another exemplary arrangement of the rollers of FIG. 14.

In an example embodiment of a roller coaster according to the present invention, the station exit cam 24 and/or the station entry cam 26 may be provided with one or more roller elements 27 along the surface that are contacted by the first and second sliding pads 34, 36. Thus, rather than sliding contact between the cams 24, 26 and the pad 34, 36 the pads 34, 36 roll along roller elements 27. The roller elements 27 may be fabricated from, e.g., a chain-like system of elements, as illustrated in FIG. 14. FIG. 14 is a side elevational view of the station exit cam 24 and/or the station entry cam 26. The roller elements 27 may be arranged serially or in a staggered manner, as illustrated in FIGS. 15 and 16, respectively. FIGS. 15 and 16 illustrate at top portion of the station exit cam 24 or station entry cam 26.

Figure 17:
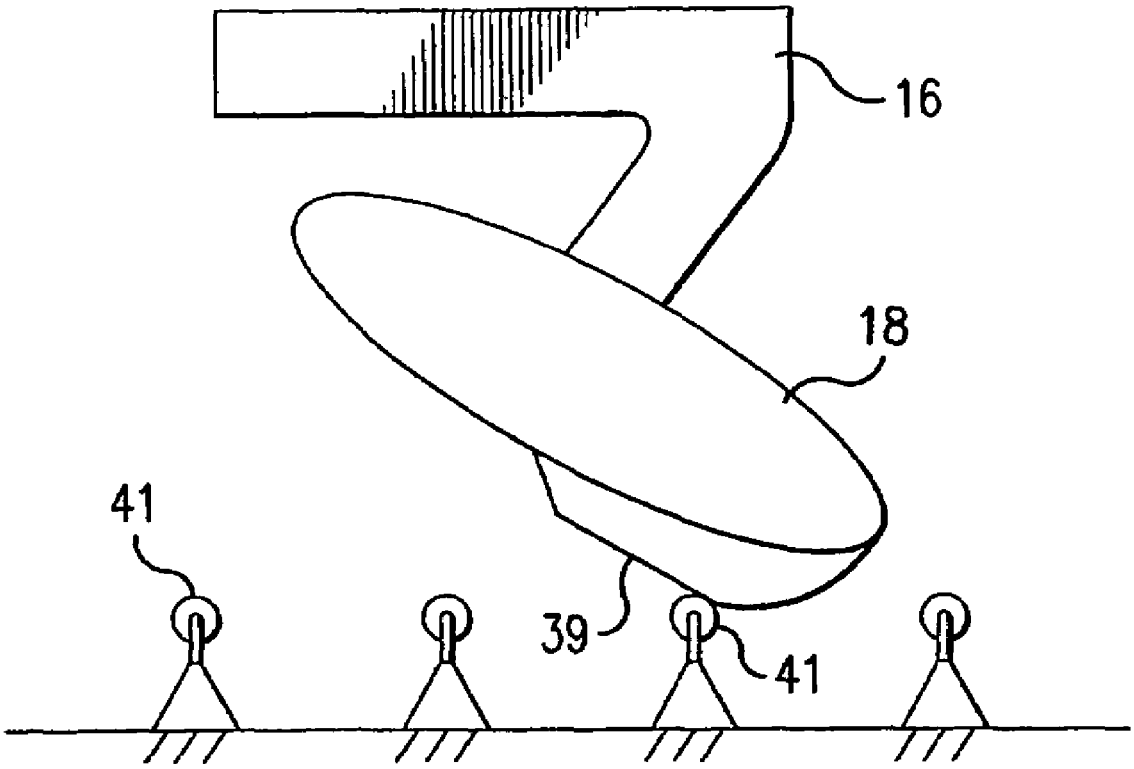
FIG. 17 is a side elevational view of an example embodiment of the roller coaster with a station exit or entry follower and a cam on the underside of the cab.

In an example embodiment of the roller coaster according to the present invention, illustrated in FIG. 17, in place of the cams 24, 26 or sliding pads 34, 36 a station exit follower 41, e.g., a roller or series of rollers, may be arranged at the station exit and a station entry follower, e.g., a roller or series of rollers, may be arranged at the station entry. A cam or series of cams 39 may be provided on the underside of the cab 18.

In an example embodiment of the roller coaster according to the present invention another mechanical, magnetic, or electrical system, internal to the cab 18 or provided stationary to the station, may be provided to rotate the cab 18 between the loading/unloading position and the riding position, e.g., a hydraulic lift, a pneumatic lift, a cable hoist, chain hoist, geared transmission, screw drive, magnet, piston, cylinder, linear motor, rotary motor, screw jack, lever jack, ratchet mechanism, cantilever mechanism, floatation mechanism, buoyancy mechanism, air-, gas- or fluid-drive mechanisms, etc. Any combination of mechanisms, including different mechanisms at station entry and exit may be provided.

The cams of any of the above-described example embodiments and/or the followers may wholly or partially be formed of a lubricious material, e.g., a fluoropolymer, PTFE, a material with a lubricant, a sintered material, an impregnated material, etc. A lubricant or grease may be provided between any of the cams and followers of the above-described example embodiments.

What is claimed is:

1. A roller coaster, comprising:

a carriage;

a cab at least pivotally connected to the carriage, the cab at least rotatable relative to the carriage between a first position substantially parallel to a track and a second position non-parallel to the track; and at least one of a station entry cam having a first predetermined profile and a station exit cam having a second predetermined profile;

wherein the cab includes a sliding pad mechanism configured to slide on at least one of the at least one of the station entry cam and the station exit cam to move the cab from a first one of the first position and the second position to a second one of the first position and the second position;

wherein the sliding pad mechanism includes a first sliding pad and a second sliding pad arranged in longitudinal alignment with respect to the first sliding pad, at least one of (a) the first sliding pad and (b) the second sliding pad pivotable with respect to the cab.

2. The roller coaster according to claim 1, wherein the cab includes a cage.

3. The roller coaster according to claim 1, wherein at least one of (a) the first sliding pad and (b) the second sliding pad is connected to the cab via an arm.

4. The roller coaster according to claim 3, wherein at least one of (a) the first sliding pad and (b) the second sliding pad is adapted to trigger an extension of a security bar.

5. The roller coaster according to claim 1, wherein the cab is connected to a locking mechanism.

6. The roller coaster according to claim 1, wherein the carriage is connected to a locking mechanism.

7. The roller coaster according to claim 1, wherein a handle is provided on the outside of the cab.

8. The roller coaster according to claim 1, wherein at least one of (a) the station entry cam and (b) the station exit cam includes at least one roller.

9. A roller coaster, comprising:

a track;

a carriage movable along the track;

a cab at least pivotally connected to the carriage, the cab at least rotatable relative to the carriage between a first position substantially parallel to the track and a second position non-parallel to the track; and at least one of a station entry cam having a first predetermined profile and a station exit cam having a second predetermined profile;

wherein the cab includes a sliding pad mechanism configured to slide on at least one of the at least one of the station entry cam and the station exit cam to move the cab from a first one of the first position and the second position to a second one of the first position and the second position;

wherein the sliding pad mechanism includes a first sliding pad and a second sliding pad arranged in longitudinal alignment with respect to the first sliding pad, at least one of (a) the first sliding pad and (b) the second sliding pad pivotable with respect to the cab.

10. The roller coaster according to claim 9, wherein the cab includes a cage.

11. The roller coaster according to claim 9, wherein the carriage is suspended to the track via rollers.

12. The roller coaster according to claim 9, wherein at least one of (a) the first sliding pad and (b) the second sliding pad is connected to the cab via an arm.

13. The roller coaster according to claim 12, wherein at least one of (a) the first sliding pad and (b) the second sliding pad is adapted to trigger an extension of a security bar.

14. The roller coaster according to claim 9, wherein the cab is connected to a locking mechanism.

15. The roller coaster according to claim 9, wherein the carriage is connected to a locking mechanism.

16. The roller coaster according to claim 9, wherein a handle is provided on the outside of the cab.

17. The roller coaster according to claim 9, wherein at least one of (a) the station entry cam and (b) the station exit cam includes at least one roller.

18. A roller coaster, comprising:

track means;

carriage means movable along the track means;

cab means at least pivotally connected to the carriage means, the cab means including means for at least rotating the cab relative to the carriage means between a first position substantially parallel to the track means and a second position non-parallel to the track means; and at least one of station entry camming means and a station exit camming means;

wherein the cab means includes means for sliding on at least one of the at least one of the station entry camming means and the station exit camming means to move the cab means from a first one of the first position and the second position to a second one of the first position and the second position;

wherein the means for sliding includes first sliding pad means and second sliding pad means arranged in longitudinal alignment with respect to the first sliding pad means, at least one of (a) the first sliding pad means and (b) the second sliding pad means pivotable with respect to the cab.

* * * * *

UNITED STATES PATENT AND TRADEMARK OFFICE

CERTIFICATE OF CORRECTION

PATENT NO. : 7,640,862 B2
APPLICATION NO. : 10/592235
DATED : January 5, 2010
INVENTOR(S) : Alberto Zamperla It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 283 days.

Signed and Sealed this

Sixteenth Day of November, 2010

David J. Kappos

David J. Kappos
*Director of the United States Patent and Trademark Office*